US010773368B2

(12) United States Patent
Kunz

(10) Patent No.: US 10,773,368 B2
(45) Date of Patent: Sep. 15, 2020

(54) MOTOR END CAP

(71) Applicant: Black & Decker Inc., New Britain, CT (US)

(72) Inventor: Michael G. Kunz, Dorndorf (DE)

(73) Assignee: Black & Decker Inc., New Britain, CT (US)

( * ) Notice: Subject to any disclaimer, the term of this patent is extended or adjusted under 35 U.S.C. 154(b) by 254 days.

(21) Appl. No.: 15/629,888

(22) Filed: Jun. 22, 2017

(65) Prior Publication Data

US 2017/0368673 A1 Dec. 28, 2017

(30) Foreign Application Priority Data

Jun. 23, 2016 (GB) ..... 1610953

(51) Int. Cl.
*B25D 16/00* (2006.01)
*B25D 17/20* (2006.01)
(Continued)

(52) U.S. Cl.
CPC ..... *B25D 16/006* (2013.01); *B25D 11/12* (2013.01); *B25D 17/043* (2013.01); *B25D 17/20* (2013.01);
(Continued)

(58) Field of Classification Search
CPC ..... B25D 16/006; B25D 16/00; B25D 11/12; B25D 11/00; B25D 17/043; B25D 17/20;
(Continued)

(56) References Cited

U.S. PATENT DOCUMENTS 5,624,000 A * 4/1997 Miller ..... B25F 5/001 173/104
6,176,321 B1 * 1/2001 Arakawa ..... B25D 16/006 173/29
(Continued)

FOREIGN PATENT DOCUMENTS

EP 1695796 8/2006
EP 2371493 10/2011
(Continued)

OTHER PUBLICATIONS

Extended EP search report dated Nov. 23, 2017 issued in corresponding EP application No. 17172355.4.
(Continued)

*Primary Examiner* — Dariush Seif
(74) *Attorney, Agent, or Firm* — Amir Rohani

(57) ABSTRACT

A drill comprising: a body, the body comprising a housing formed internally with at least two chambers; a rear handle mounted on the body; a tool holder mounted on the front of the body; an electric motor mounted in a first chamber, the electric motor comprising an end cap attached to a motor housing; a transmission mechanism mounted in a second chamber which is in driving connection with the electric motor, the transmission mechanism being driven by the electric motor when the electric motor is activated to either impart impacts to and/or rotate a cutting tool when held by the tool holder. The end cap engages with the housing to form a separating wall which separates the first and second chambers.

12 Claims, 7 Drawing Sheets

(51) Int. Cl.
*B25D 11/12* (2006.01)
*B25D 17/04* (2006.01)

(52) U.S. Cl.
CPC *B25D 2211/068* (2013.01); *B25D 2217/0061* (2013.01); *B25D 2250/121* (2013.01)

(58) Field of Classification Search
CPC ..... B25D 2211/068; B25D 2217/0061; B25D 2250/121; B25D 2250/095; B23B 2260/062; B23B 45/00; B23B 45/001; B25F 5/02
USPC ..... 173/217, 48, 117, 93, 93.5, 216; 310/85, 310/89, 90, 91
See application file for complete search history.

(56) References Cited

U.S. PATENT DOCUMENTS 6,661,140 B2 * 12/2003 Agnes ..... H02K 1/185 310/179
6,781,267 B2 * 8/2004 Ortt ..... H02K 1/28 310/50
6,909,218 B2 * 6/2005 Ortt ..... H01R 39/385 310/239
6,927,509 B2 * 8/2005 Cichetti, Sr. ..... H02K 5/20 310/214
7,459,819 B2 * 12/2008 Finkenbinder ..... F04D 25/06 310/239
8,278,803 B2 * 10/2012 Lin ..... H02K 5/15 310/402
8,415,846 B2 * 4/2013 Best ..... H02K 5/10 310/43
8,479,840 B2 * 7/2013 Hartmann ..... B25F 5/008 173/109
9,174,289 B2 * 11/2015 Ginocchini ..... B23D 45/048
2002/0117931 A1 * 8/2002 Campbell ..... H02K 5/1672 310/238
2004/0124727 A1 * 7/2004 Lau ..... B23B 45/008 310/83
2004/0211575 A1 * 10/2004 Soika ..... B25D 17/00 173/48
2005/0034883 A1 * 2/2005 Yamada ..... B25F 5/008 173/217
2005/0251949 A1 * 11/2005 Rosa ..... A46B 5/0083 15/340.4
2009/0058209 A1 * 3/2009 Baranowski ..... H02K 5/24 310/91
2009/0160268 A1 * 6/2009 Ragnone ..... H02K 11/40 310/51
2010/0127587 A1 * 5/2010 Qin ..... H02K 5/148 310/89
2010/0132968 A1 * 6/2010 Hartmann ..... B25F 5/008 173/109
2010/0148600 A1 * 6/2010 Bauer ..... F16C 17/026 310/52
2010/0193206 A1 * 8/2010 Teng ..... B25B 21/02 173/48
2010/0319945 A1 * 12/2010 Chen ..... B23B 45/008 173/48
2011/0011608 A1 * 1/2011 Saur ..... B25D 11/062 173/162.2
2011/0308828 A1 * 12/2011 Shinma ..... B25F 5/008 173/114
2013/0091662 A1 * 4/2013 Smith ..... A47L 9/1683 15/353
2013/0091814 A1 * 4/2013 Smith ..... A47L 9/1633 55/345
2014/0338948 A1 * 11/2014 Hester ..... B25F 5/008 173/217
2015/0214818 A1 * 7/2015 Osborne ..... H02K 23/04 310/50
2016/0149463 A1 * 5/2016 Smith ..... H02K 1/28 310/50
2016/0149474 A1 * 5/2016 Smith ..... H02K 1/276 310/50
2016/0181891 A1 * 6/2016 Fogle ..... H02K 11/215 310/43
2016/0229045 A1 * 8/2016 Hashimoto ..... B25F 5/008

FOREIGN PATENT DOCUMENTS

GB 2397857 8/2004
WO 2015093057 6/2015

OTHER PUBLICATIONS

UK Search Report dated Dec. 14, 2016 issued in corresponding UK patent application No. GB1610953.0.

* cited by examiner

MOTOR END CAP

CROSS-REFERENCE TO RELATED APPLICATIONS

This application claims priority, under 35 U.S.C. § 119, to UK Patent Application No. 16 109 53.0, filed Jun. 23, 2016, titled "Motor End Cap", contents of which are incorporated herein by reference in entirety.

FIELD

The present invention relates to a drill having a motor with an end cap which forms a separating wall between two chambers inside of the drill.

BACKGROUND

Drills, hammer drills and chippers are power tools that can operate in at least one of three modes of operation. Drills, hammer drills and chippers have a cutting tool such as a drill bit or chisel that can be operated in at least one of a hammering mode, a rotary mode and a combined hammer and rotary mode. Drills, hammer drills and chippers will typically comprises an electric motor and a transmission mechanism by which the rotary output of the electric motor rotationally drives the cutting tool and/or repetitively strikes the cutting tool to perform the hammer function. Such a transmission mechanism can be mounted within a transmission housing which is in turn mounted within an external housing of the hammer drill. The electric motor can be directly mounted onto the transmission housing. The use of such a transmission housing allows the transmission mechanism to be assembled within the transmission housing and the electric motor mounted onto the transmission housing with the rotary output of the electric motor being drivingly connected to the transmission mechanism to form a single sub-assembly which can then inserted into the external housing.

EP1674215 discloses a hammer drill capable of operating in all three modes of operation and which has a transmission mechanism mounted within a transmission housing and an electric motor mounted onto the transmission housing which are then mounted within an external housing.

SUMMARY

Accordingly there is provided a drill comprising: a body, the body comprising a housing formed internally with at least two chambers; a rear handle mounted on the body; a tool holder mounted on the front of the body; an electric motor mounted in a first chamber, the electric motor comprising an end cap attached to a motor housing; a transmission mechanism mounted in a second chamber which is in driving connection with the electric motor, the transmission mechanism being driven by the electric motor when the electric motor is activated to either impart impacts to and/or rotate a cutting tool when held by the tool holder. The end cap engages with the housing to form a separating wall which separates the first and second chambers.

An embodiment of the invention will now be described with reference to the accompanying drawings.

DETAILED DESCRIPTION

Figure 1:
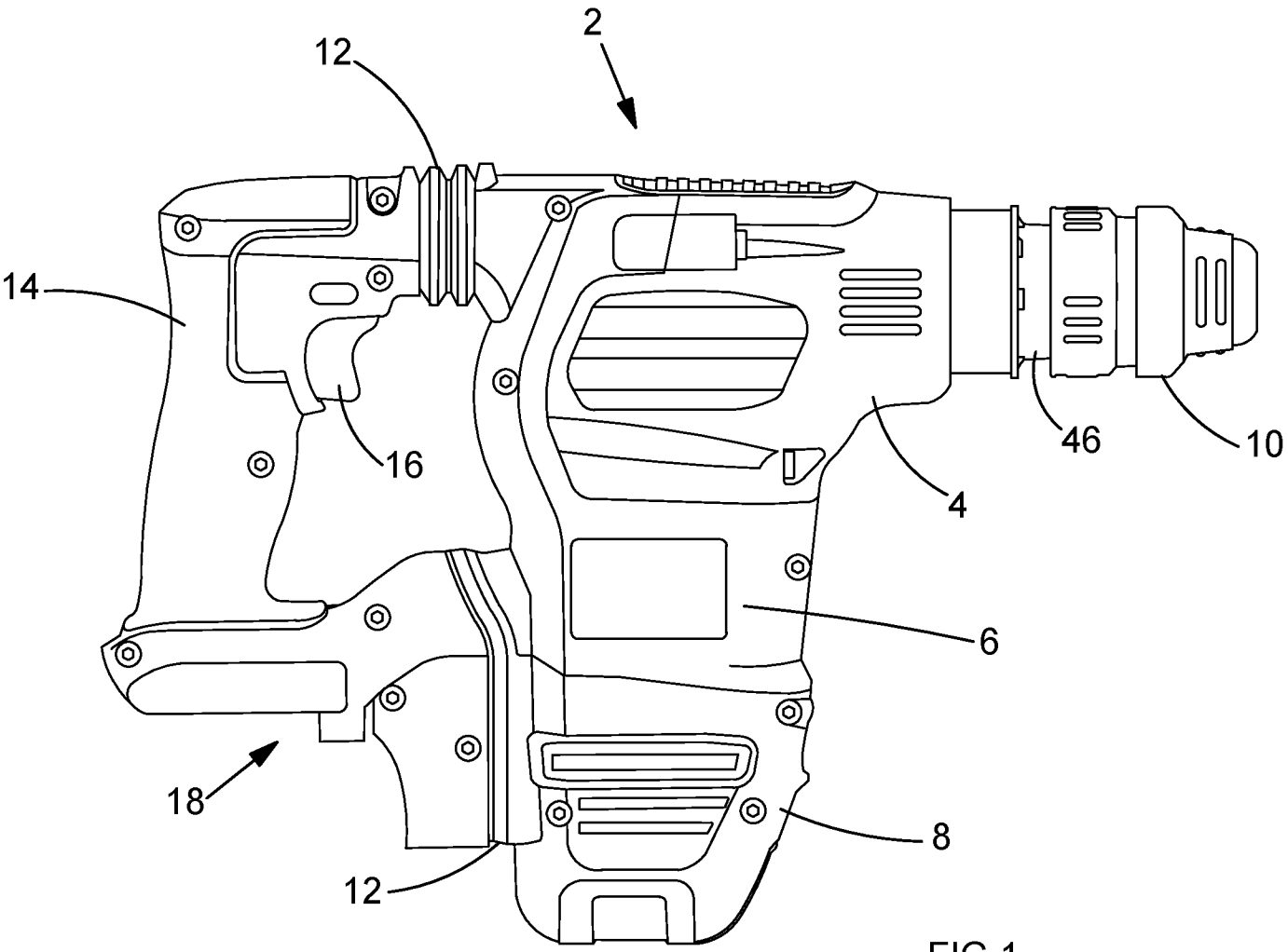
FIG. 1 is a side view of a hammer drill.

Referring to FIG. 1, a battery-powered hammer drill comprises a body 2 having an external tool housing formed from a number of clam shells 4, 6, 8 connected to each other, and a tool holder 10 for holding a cutting tool such as a drill bit (not shown). Mounted on the body 2 via a vibration dampening mechanism 12 (which is not described in any detail as it does not form part of the present invention), is a handle 14 having a trigger 16 for activating the hammer drill. A battery pack (not shown) can be releasably attached within a receptacle 18 attached to the bottom of the handle 14. A mode selector knob (not shown) is provided on the side of the body 2 for selecting the mode of operation of the hammer drill, the modes of operation being a hammer only mode, a rotary only mode and a combined hammer and rotary mode.

Figure 2:
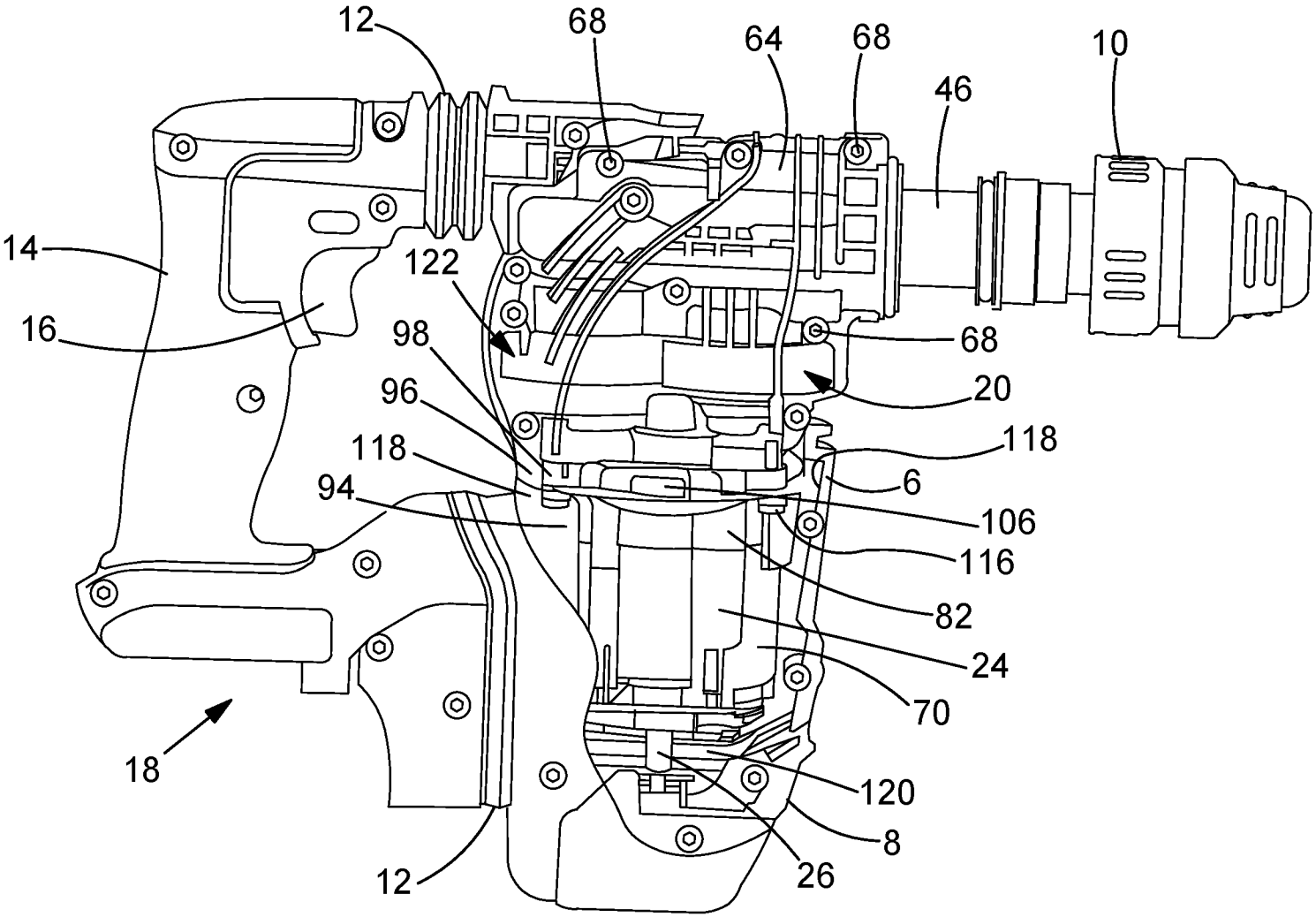
FIG. 2 shows a side view of the hammer drill of FIG. 1 with half of the external housing removed.

Referring to FIG. 2, mounted inside of the body 2 is a transmission housing 20, in which is mounted a transmission mechanism 22 (described in more detail below), and an electric motor 24 (described in more detail below) attached to the transmission housing 22.

Figure 3:
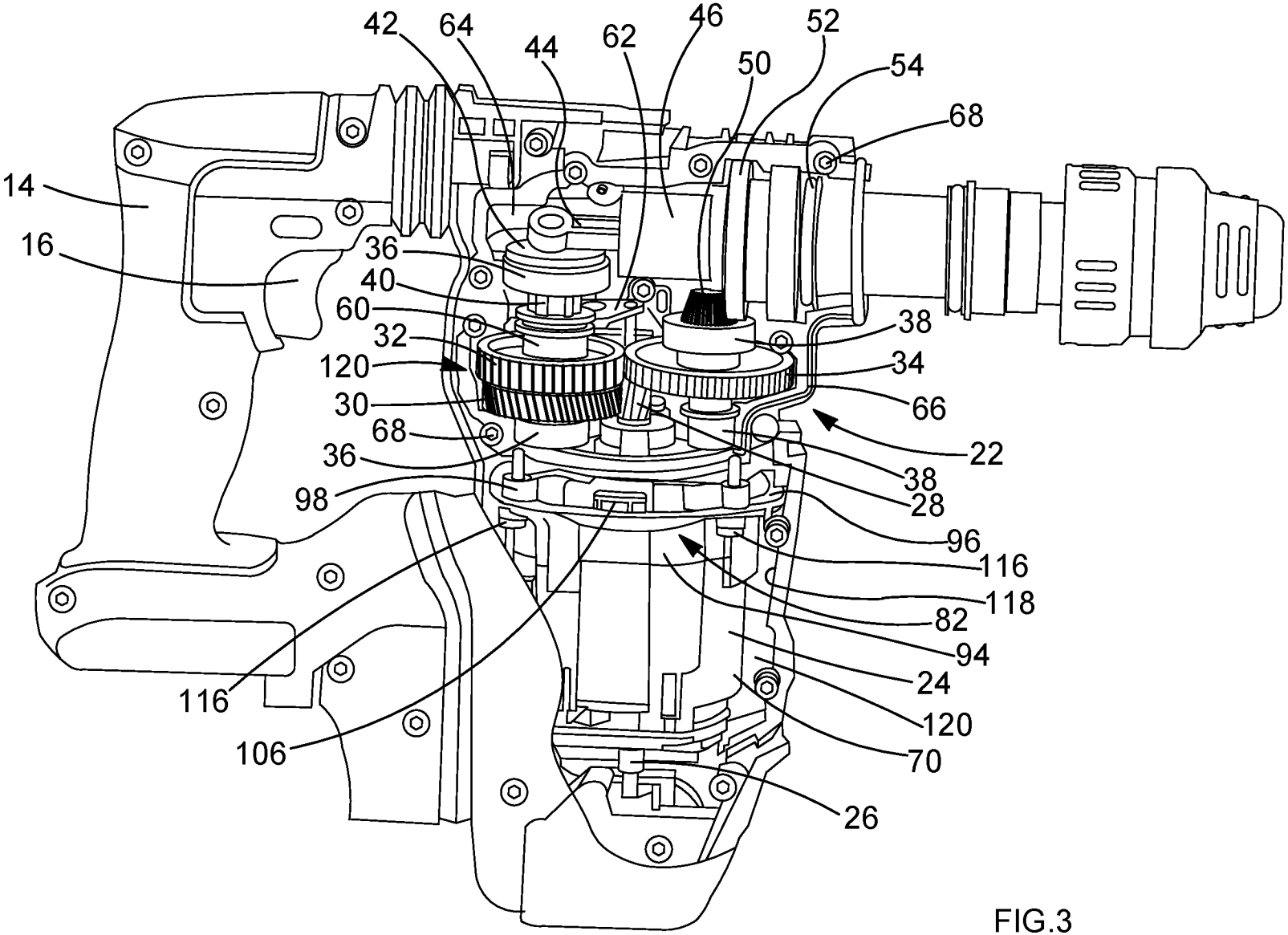
FIG. 3 shows a side view of the hammer drill of FIG. 1 with half of the external housing and half of the transmission housing removed.
Figure 4:
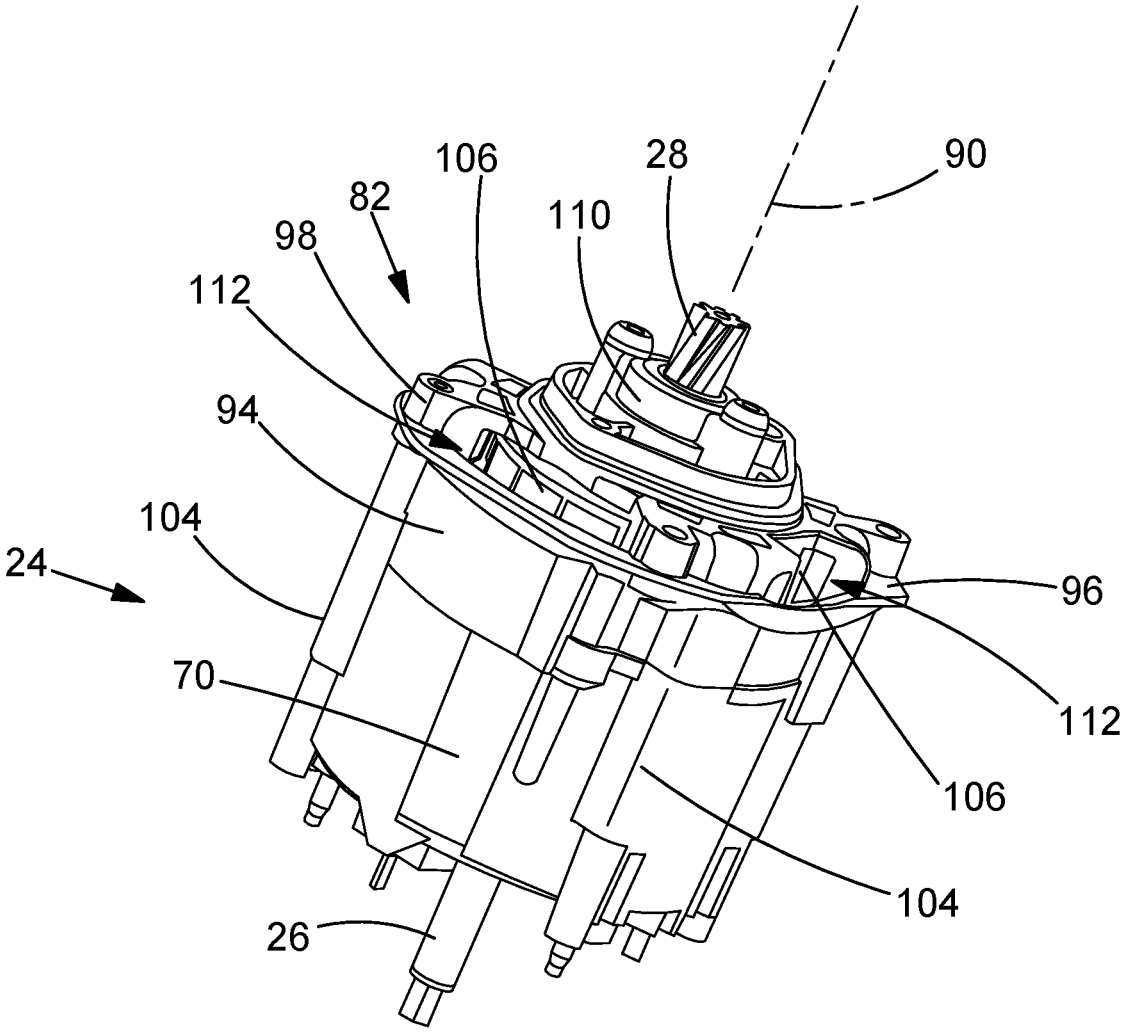
FIG. 4 shows a perspective view of the electric motor.
Figure 5:
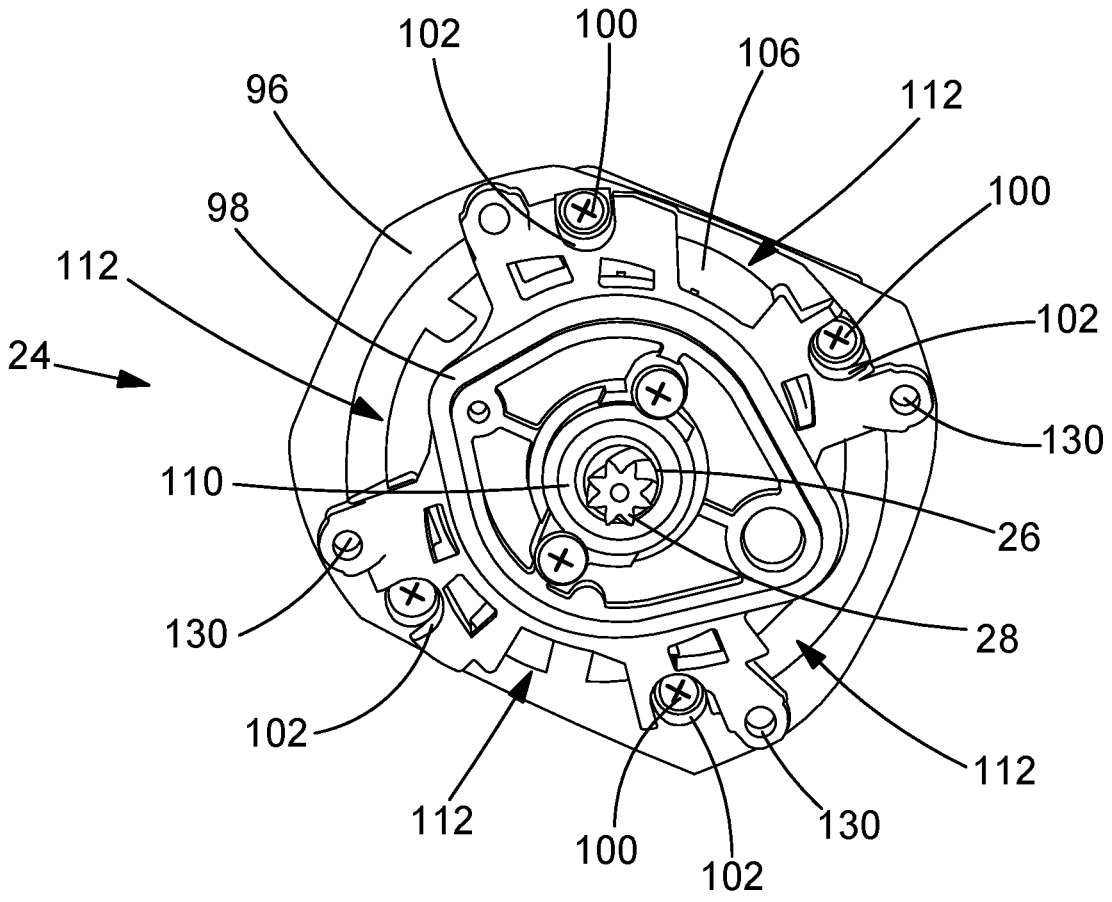
FIG. 5 shows a top view of the electric motor.
Figure 6:
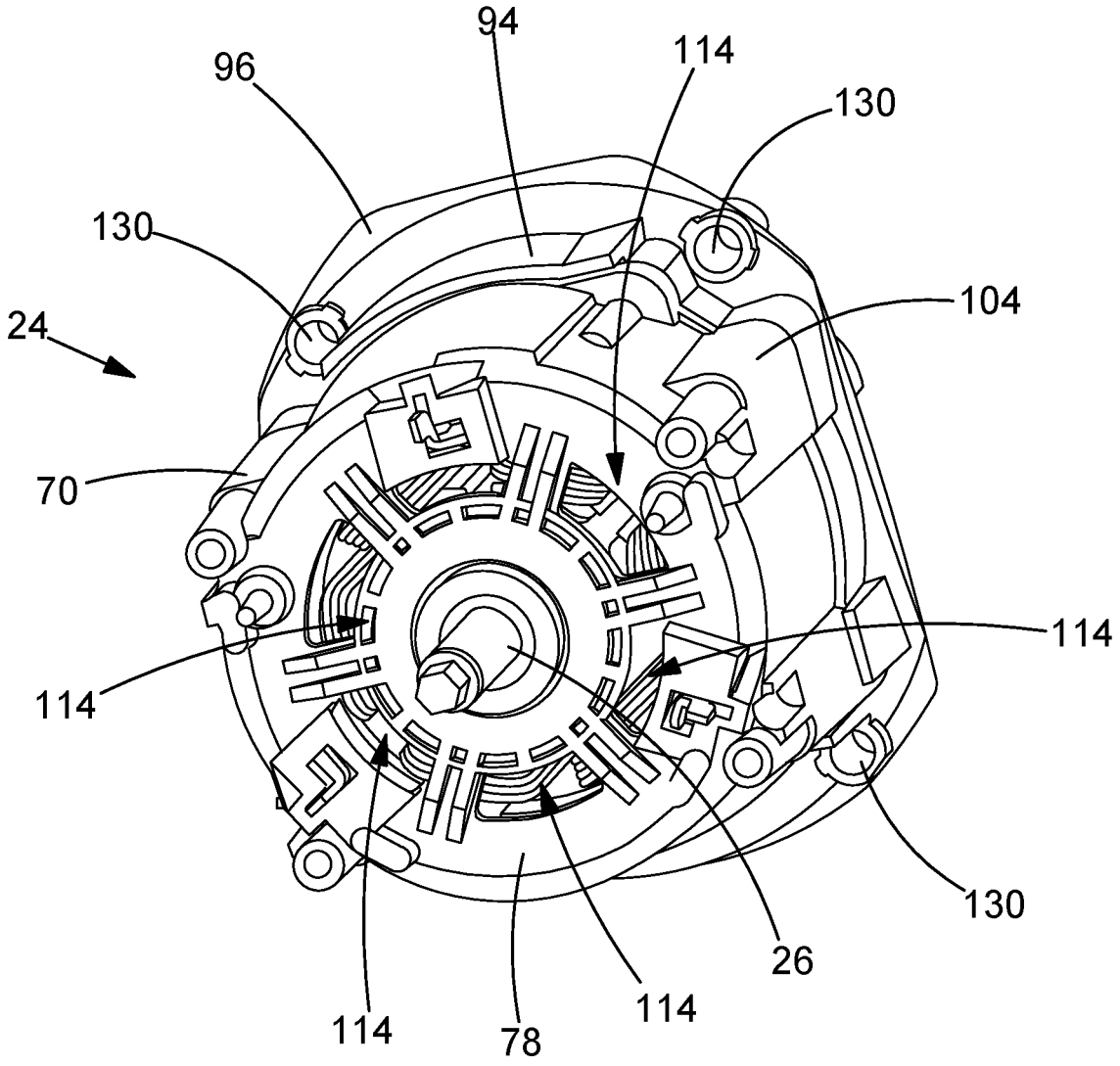
FIG. 6 shows a bottom view of the electric motor.
Figure 7:
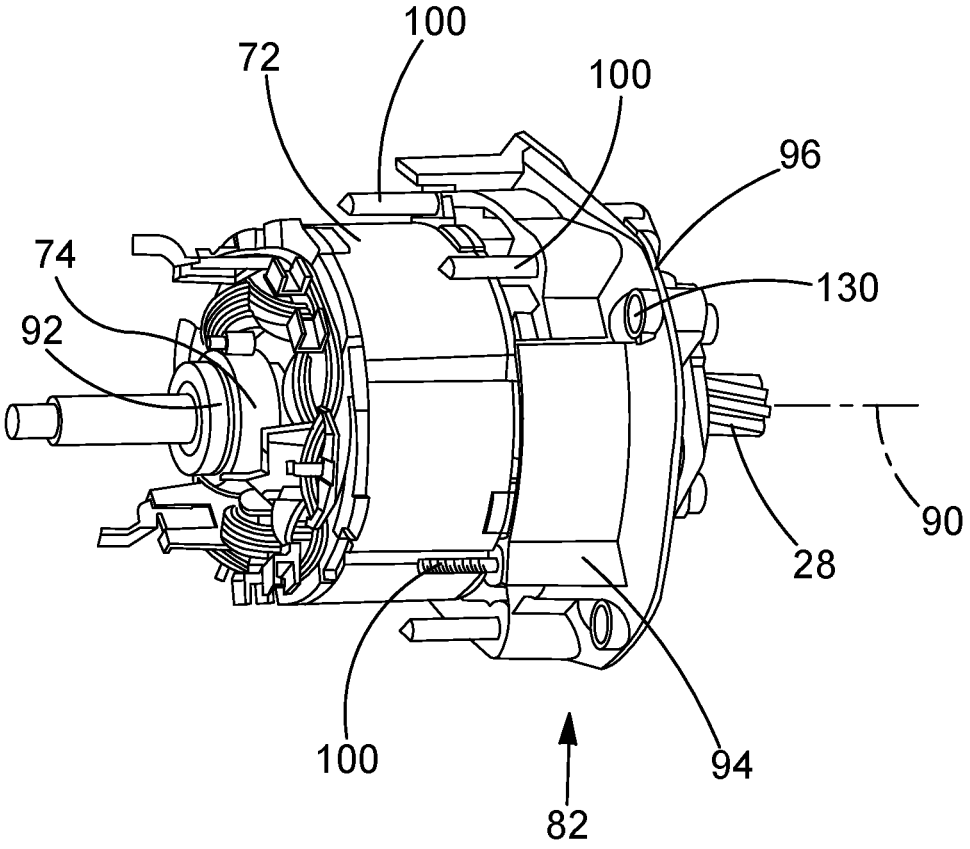
FIG. 7 shows a side view of the electric motor with the tubular can removed.

Referring to FIG. 3, the electric motor 24 has an output shaft 26 which extends into the transmission housing 20. The end of the output shaft 26 has a pinion 28 formed on it. The transmission mechanism comprises a first gear 30 rigidly attached to a first rotatable shaft (not shown), which meshes with the pinion 28 such that rotation of the pinion 28 results in rotation of the first gear 30, which in turn results in rotation of the first rotatable shaft. The first rotatable shaft is rotatably mounted within a first set of bearings 36.

Mounted on the end of the first rotatable shaft in a freely rotatable but non-axially slideable manner is a fourth gear 40. A crank plate 42 is rigidly attached to the fourth gear 40. A crank shaft 44 is pivotally attached at one of its ends to an eccentric pin (not shown) mounted on the crank plate 42. A piston (not shown) is pivotally attached to the other end of the crank shaft 44. The piston is slidingly mounted within a rotatable output spindle 46. Rotation of the fourth gear 40 results in rotation of the crank plate 42, together with the eccentric pin, which in turn results in the reciprocation of the piston within the output spindle 46. The piston forms part of a hammer drive mechanism. The reciprocating movement of the piston drives the hammer drive mechanism. Hammer drive mechanisms are well known in art and any suitable design of hammer mechanism can be used. As the design of such a hammer mechanism does not form part of the invention, no further description of the hammer drive mechanism Mounted on the first rotatable shaft in a freely rotatable but non-axially slideable manner is a second gear 32. The second gear 32 meshes with a third gear 34 which is rigidly mounted on a second rotatable shaft (not shown). The second rotatable shaft is rotatably mounted with a second set of bearings 38. Rigidly mounted on the end of the second rotatable shaft is a first bevel gear 50. The first bevel gear 50 meshes with a second bevel gear 52 mounted on the output spindle 46. The second bevel gear 52 is drivingly connected to the output spindle 46 via a torque clutch 54. When the torque across the torque clutch 54 is below a pre-set value, the rotary movement of the second bevel gear is transferred to the output spindle 46. When the torque across the torque clutch 54 is above the pre-set value, the torque clutch 54 slips and no rotary movement of the second bevel gear 52 is transferred to the output spindle 46. Rotation of the second gear 32 results in rotation of third gear 34, the second rotatable shaft and first bevel gear 50. Rotation of the first bevel gear 50 results in rotation of the second bevel gear 52 which results in rotation of the out spindle 46, so long as the torque clutch does not slip. The tool holder 10 is mounted on the output spindle 46 and therefore rotation of the output spindle 46 results in rotation of the tool holder 10. The design of torque clutches are well know if the art and any suitable design can be used. As the torque clutch does not form part of the invention, no further description will be provided.

Mounted on the first rotatable shaft in a non-rotatable but axially slideable manner is a mode change sleeve 60. As such, the rotation of the first rotatable shaft results in rotation of the mode change sleeve 60. In certain axial positions, the mode change sleeve 60 can mesh with the second gear 32 to drivingly engage the second gear 32. When the mode change sleeve 60 drivingly engages the second gear 32, the rotation of the first rotatable shaft results in rotation of the mode change sleeve 60 which in turn rotatingly drives the second gear 32. In certain other axial positions, the mode change sleeve 60 can mesh with the fourth gear 40 to drivingly engage the fourth gear 40. When the mode change sleeve 60 drivingly engages the fourth gear 40, the rotation of the first rotatable shaft results in rotation of the mode change sleeve 60 which in turn rotatingly drives the fourth gear 40.

A mode change mechanism 62 can move the mode change sleeve 60 between three axial positions on the first rotatable shaft. In a first lowest position, the mode change sleeve 60 is in driving engagement with the second gear 32 only. As such, rotation of the first rotatable shaft results in rotation of the mode change sleeve 60 which in turn rotatingly drives the second gear 32 only, the fourth gear 40 remaining disengaged from the mode change sleeve 60. As such, the hammer drill works in rotary only mode. In a second middle position, the mode change sleeve 60 is in driving engagement with both the second gear 32 and the fourth gear 40. As such, rotation of the first rotatable shaft results in rotation of the mode change sleeve 60 which in turn rotatingly drives both the second gear 32 and the fourth gear 40. As such, the hammer drill works in a combined hammer and rotary mode. In a third highest position, the mode change sleeve 60 is in driving engagement with the fourth gear 40 only. As such, rotation of the first rotatable shaft results in rotation of the mode change sleeve 60 which in turn rotatingly drives the fourth gear 40 only, the second gear 32 remaining disengaged from the mode change sleeve 60. As such, the hammer drill works in hammer only mode. The design of mode change mechanisms are well know if the art and any suitable design can be used. As the mode change mechanism does not form part of the invention, no further description will be provided.

The transmission mechanism 22 is mounted in the transmission housing which comprises two clam shells 64 fastened together with screws 68. A seal 66 is sandwiched between the edges of the clam shells 64 to seal lubrication grease inside of the transmission housing 20.

The electric motor 24 will now be described with reference to FIGS. 4 to 7.

The electric motor 24 is a brushless motor which comprises a tubular can 70 of generally circular cross section which is open at the top end and which has a longitudinal axis 90. Mounted inside of the tubular can is a stator 72. The stator 72 has a passageway formed through it. An armature 74 is mounted onto the output shaft 26. The armature 74 is located inside of the stator 72, with the longitudinal axis 90 of the output shaft 26 extending in a direction co-axial to that of the can 70, the output shaft 26 extending through the length of the can 70.

Integrally formed as part of the can 70, at the lower end of the can 70, is a base plate 78. The base plate 78 supports a first bearing 92 which supports one end of the output shaft 26 in a rotary manner. The output shaft 26 extends through the base plate 78 and away from the can 70. Electric cables (not shown) are also mounted on to the base plate 78 and connect to the stator 72 to provide power and controls signals to the motor 24.

Attached to the upper end of the can 70 is an end cap 82. The end cap 82 is manufactured in a one piece construction and comprises three sections; a first section 94 located adjacent the can 70, a second section 98 located remote from the can 70 and a third section 96, separating the first and second sections, comprising a radial flange which extends generally outwardly in a direction perpendicular to the longitudinal axis 90 of the can 70. The end cap 82 is secured to the can 70 using four screws 100 which are inserted through four apertures 102 formed in the end cap 82 and screwed into four threaded bosses 104 formed in the can 70.

The end cap 82 supports a second bearing 110, the second bearing 110 rotationally supporting the output shaft 26, the output shaft 26 passing through the end cap 82 and extending away from the can 70 and end cap 82.

A radial fan 106 is mounted on the output shaft 26 adjacent the armature 74. The majority of the fan 106 locates inside of the end cap 82, the remainder being located inside of the end of the can 70 adjacent the end cap 82. A first series of apertures 112 are formed in the second section 98 of the end cap 82. The inside wall of the end cap 82 surrounding the fan 106 is shaped to form a baffle to guide the air expelled radially be the rotating fan 106 towards and through the first series of apertures 112. The end of the can 70 adjacent the end cap 82 is shaped to form a baffle which co-operates with the baffle formed inside of the end cap 82 to guide the air. It will be appreciated that as an alternative design, the whole of the baffle could be formed inside of the end cap 82.

Formed in the base plate 78 is a second series of apertures 114.

When the motor 24 is activated, the armature 74, the fan 106 and the output shaft 26 rotate. The rotating fan 106 draws air into the motor 24 through the second series of apertures 114. The air passes through the inside of the can 70, passing over the armature 74 and the stator 72, and is drawn into the radial fan 106. The radial fan 106 expels the air in a radial direction. The baffle formed by the inside wall of the end cap 82 then guides the air towards and directs it through the first series of apertures 112. The flow of air through the motor 24 cools the motor down.

When the motor 24 is assembled, the stator 72 is secured inside of the can 70. The armature 74 and fan 106, which have been mounted onto the output shaft 26, are inserted into the stator 72 within the can 70, the output shaft 26 being supported by the first bearing 92 in the base plate 78. The end cap 82 is then secured to the can 70 using the screws 100 with the second bearing 110 supporting the output shaft 26. The construction of motor 24 using a can 70 with an integral base plate 78 which is sealed by an end cap 82 produces a standalone component which can be manufactured and tested remotely from the rest of the hammer drill.

When the hammer drill is assembled, the transmission mechanism 22 is assembled and mounted inside of the transmission housing 20, the two clam shells 64 of the transmission housing 20 being fastened together with screws 68 to support and seal in the transmission mechanism 22. The construction of such a transmission mechanism 22 mounted within such a transmission housing 20 (collectively referred to as a transmission) produces a standalone component which can be manufactured and tested remotely from the rest of the hammer drill.

The assembled electric motor 24 is then attached to the assembled transmission. The output shaft 26, which extends from the end cap 82, is inserted into the transmission housing 20 through an aperture in the transmission housing 20 and is engaged with the first gear 30, the pinion 28 meshing with the first gear 30 inside of the transmission housing 20. The second section 98 of the end cap 82 then abuts against the base of the transmission housing 20. The end cap 82 is then secured to the transmission housing 20 by using bolts 116 which pass through apertures 130 in the end cap and engage with threaded bores (not shown) formed in the transmission housing 20. The securing of the end cap 82 to the transmission housing 20 attaches the electric motor 24 to the transmission housing 20 and transmission mechanism 22. Attachment of the transmission to the motor 24 produces a standalone component which can be assembled and test separately from the rest of the hammer drill.

The assembled transmission and motor 24 are then inserted into the external tool housing 4, 6, 8. The transmission housing 20 is then secured to the external housing 4, 6, 8 using fasteners (not shown). This results in the electric motor 24 being secured indirectly to the external housing 4, 6, 8 via the transmission housing 20.

When the assembled transmission and motor 24 is located inside of the external housing 4, 6, 8, the periphery of the flange of the third section 96 of the end cap 82 engages with an internal wall 118 of the external tool housing 4, 6, 8, the flange forming an internal wall inside of the hammer drill. The flange forms part of a separating wall between two cambers 120, 122 formed inside of the external tool housing 4, 6, 8 when the assembled transmission and motor 24 are located inside of the external housing 4, 6, 8. The first chamber 120 is formed on the side of the flange where the first section 94 of the end cap and the can 70 of the motor 24 are positioned with the motor 24 extending into and being located in the first chamber 120. The second chamber 122 is formed on the side of the flange which is remote from the can 70. The transmission mechanism 22 and transmission housing 20 is mounted within the second chamber 122.

The first series of apertures 112 in the end cap 82 are located inside of the second chamber 122. The second series of apertures 114 in the base plate 78 are located in the first chamber 120. Air is drawn from the first chamber 120 into the motor 24 through the second series of apertures 114. Air is then expelled from the first series of apertures 112 into the second chamber 122. The flange prevents air from moving from the first chamber 120 to the second chamber 122 except by passing through the motor 24.

The invention claimed is:

1. A power tool comprising:

a tool housing internally including a first chamber and a second chamber;

a tool holder mounted on the tool housing;

a motor housing disposed within the first chamber, the motor housing including a radially-orientated base plate and a tubular can;

an electric motor comprising a stator disposed within the motor housing and an output shaft rotatably passing through the stator;

a transmission mechanism disposed within the second chamber in driving connection with the electric motor, the transmission mechanism being driven by the electric motor;

an end cap attached to an end portion of the motor housing opposite the base plate; and a fan mounted on the output shaft within the end cap, the fan including a radial fan plate and a plurality of fan blades projecting from the radial fan plate in the direction of the electric motor to generate an air flow, wherein the end cap comprises: an inside wall surrounding a portion of the plurality of fan blades and shaped to form a baffle for guiding the air flow generated by the fan; a first section extending from an outer circumference of the inside wall partially along an outer surface of the motor housing to radially secure the end cap with respect to the motor housing; a second section forming a first plurality of apertures around a periphery of the radial fan plate; and a third section that extends outwardly from the outer circumference of the inside wall forming a flange along a radial plane that engages with the tool housing to form a separating wall separating the first and second chambers, wherein the base plate of the motor housing forms a second plurality of apertures; the air flow generated by the fan enters the motor housing from the first chamber through the second plurality of apertures of the base plate, travels substantially axially through the electric motor in the direction of the fan, and is guided by the baffle in a substantially radially-outward direction through the first plurality of apertures of the second section of the end cap to be exhausted from the motor housing to the second chamber; and the separating wall fully seals the first chamber from the second chamber around the periphery of the motor to prevent air from moving between the first chamber and the second chamber except by passing through the motor.

2. A power tool according to claim 1, wherein the tool housing comprises an internal wall, the end cap engaging, at least in part, with the internal wall of the tool housing to form the separating wall.

3. A power tool according to claim 1, wherein the electric motor further comprises an armature mounted on the output shaft, the armature being located inside of the stator, wherein the output shaft passes through and extends beyond an opening of the base plate of the motor housing.

4. A power tool according to claim 1, further comprising a front bearing mounted on the output shaft and supported by the end cap, the front bearing providing rotary support to the output shaft with respect to the motor housing via the end cap.

5. A power tool according to claim 4, wherein the second section of the end cap includes a plurality of legs mounted on the outer circumference of the inside wall, at least a portion of the plurality of legs extending radially towards the front bearing and forming a support structure around the front bearing, the plurality of legs forming the first plurality of apertures therebetween.

6. A power tool according to claim 4, further comprising a rear bearing mounted on the output shaft on a side of the stator opposite the front bearing, the rear bearing being supported by the base plate of the motor housing.

7. A power tool according to claim 1, further comprising a rear handle mounted on the tool housing.

8. A power tool according to claim 1, wherein the transmission mechanism is driven by the electric motor when electric motor is activated to either impart impacts to and/or rotate a cutting tool when held by the tool holder.

9. A power tool according to claim 1, wherein the end portion of the motor housing opposite the base plate cooperates with the inside wall of the end cap to form the baffle.

10. A power tool according to claim 1, wherein the transmission mechanism comprises a transmission housing mounted within the second chamber and the first plurality of apertures connects the motor housing with the second chamber to allow passage of the air flow generated by the fan from the motor housing to the second chamber to cool the transmission housing.

11. A power tool according to claim 1, wherein the end cap is attached to the transmission housing such that the motor housing is mounted on the transmission housing via the end cap, the transmission housing structurally securing the motor housing inside of the first chamber.

12. A power tool according to claim 1, wherein the radial plane formed by the flange of the third section of the end cap intersects at least a portion of the fan in the radial direction.

* * * * *